US010798811B2

(12) United States Patent
Kitamura et al.

(10) Patent No.: US 10,798,811 B2
(45) Date of Patent: Oct. 6, 2020

(54) INSERTION DEVICE

(71) Applicant: HITACHI METALS, LTD., Tokyo (JP)

(72) Inventors: Hideo Kitamura, Kobe (JP); Shinsaku Mizumoto, Suita (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 16/482,331

(22) PCT Filed: Jan. 31, 2018

(86) PCT No.: PCT/JP2018/003157
§ 371 (c)(1),
(2) Date: Jul. 31, 2019

(87) PCT Pub. No.: WO2018/143253
PCT Pub. Date: Aug. 9, 2018

(65) Prior Publication Data

US 2020/0053863 A1 Feb. 13, 2020

(30) Foreign Application Priority Data

Feb. 1, 2017 (JP) ..... 2017-016909

(51) Int. Cl.
*H05H 7/04* (2006.01)
*H05H 7/08* (2006.01)
*H05H 13/04* (2006.01)

(52) U.S. Cl.
CPC ..... *H05H 7/08* (2013.01); *H05H 7/04* (2013.01); *H05H 13/04* (2013.01)

(58) Field of Classification Search
CPC .... H01F 7/0221; H01F 7/0231; H01F 7/0278; H05H 7/04; H05H 7/08; H05H 13/04
See application file for complete search history.

(56) References Cited

U.S. PATENT DOCUMENTS 7,956,557 B1 * 6/2011 Waterman ..... H05H 7/04 315/501
2016/0064129 A1 3/2016 Gluskin et al.

OTHER PUBLICATIONS

International Preliminary Report on Patentability with translation of Written Opinion of the ISA dated Aug. 15, 2019, in International Application No. PCT/JP2018/003157.

(Continued)

*Primary Examiner* — Henry Luong
(74) *Attorney, Agent, or Firm* — Sughrue Mion, PLLC

(57) ABSTRACT

A device includes: a first magnet array; a first magnet support body; a second magnet array; a second magnet support body; a gap drive mechanism for performing vertical drive of the magnet support bodies to change a gap; first, second connection beams connected to the magnet support bodies; a mechanism for connecting the connection beams to the gap drive mechanism; a cancellation spring mechanism for cancelling a suction force that acts between magnet arrays; and a spring interlocking mechanism for connecting the cancellation spring mechanism to the magnet support bodies. In the spring interlocking mechanism, first and second spring support frames that are connected to the first and second connection beams via a connecting portion, and a guide mechanism for guiding vertical movements of the first and second spring support frames are mounted, and the cancellation spring mechanism are mounted to both the first and second spring support frames.

13 Claims, 22 Drawing Sheets

(56) References Cited

OTHER PUBLICATIONS

Herman Winick et al., "Wiggler and Undulator Magnets," Physics Today, May 1981, pp. 50-63 (1-14), vol. 34, Issue 5.
Ryotaro Kinjyo et al., "Development on attractive force-canceling mechanism for next generation standard undulator," Aug. 9, 2014, 15 pages.
International Search Report of PCT/JP2018/003157 dated Apr. 24, 2018.
Schmidt et al., "Horizontal-Gap Vertically-Polarizing Undulator (HGVPU) Design Challenges and Resolutions", Proceedings of MEDSI2016, Barcelona, Spain, Jun. 2017, pp. 288-292, XP002797131, 5 pages total.
Extended European Search Report dated Feb. 4, 2020, from the European Patent Office in Application No. 18748735.0.

* cited by examiner

INSERTION DEVICE

CROSS REFERENCE TO RELATED APPLICATIONS

This application is a National Stage of International Application No. PCT/JP2018/003157 filed Jan. 31, 2018, claiming priority based on Japanese Patent Application No. 2017-016909 filed Feb. 1, 2017.

TECHNICAL FIELD

The present invention relates to insertion devices including a first magnet array constituted by a plurality of magnets placed in an array, a first magnet supporting member for supporting the first magnet array mounted thereto, a second magnet array which is constituted by a plurality of magnets placed in an array and is faced to the first magnet array with a gap interposed therebetween, a second magnet supporting member for supporting the second magnet array mounted thereto, a gap driving mechanism for driving the first magnet supporting member and/or the second magnet supporting member in the direction in which the magnet arrays are faced to each other, in order to change the size of the gap, and a driving conjunction mechanism for coupling the gap driving mechanism and the magnet supporting members to each other.

BACKGROUND ART

If an electron beam having been accelerated to near the light velocity in a vacuum is bent within a magnet field, radiated light is emitted in tangential directions of the trajectory of the movement of the electron beam. This is called synchrotron radiation. There have been made studies for practical applications of various techniques for installing light sources for generating such synchrotron radiation in straight sections of electron storage rings (electron-beam accumulating rings), in order to utilize its properties such as high directivity, high intensity, and high polarization properties. Existing electron storage rings have been provided with plural insertion devices (undulators), as high-brightness light sources with higher beam electric currents and smaller beam cross-sectional areas.

As such insertion devices, there has been known an insertion device disclosed in the following Non-Patent Document 1, for example. This insertion device has a structure including a first magnet array constituted by a plurality of magnets placed in an array, and a second magnet array constituted by a plurality of magnets placed in an array, which are faced to each other with a gap interposed therebetween. Since the arrays of the plural magnets are faced to each other, large attractive forces are exerted between both of them. Due to the exertion of the attractive forces, large loads are induced in gap driving mechanisms, which causes degradation of precise gap driving and deformations of magnet supporting members supporting the magnet arrays, thereby disordering the magnetic-field intensity distribution in the direction of an electron beam, which has been initially set in the magnetic-field generating space (the gap). This has resulted in the problem of impossibility of generation of synchrotron radiation with desired properties.

The following Patent Document 1 discloses a structure provided with compensation springs, in order to overcome the aforementioned problem. In this insertion device, girders for supporting magnet arrays are driven in vertically upward and downward directions, through gap driving mechanisms provided on a primary frame configuration (primary frame). This gap driving mechanisms are for changing the size of a gap. Further, the girders for supporting the magnet arrays are supported by secondary C-frame configurations (secondary C-frames) with spring assemblies interposed therebetween. The secondary C-frame configurations are coupled to both the left and right sides of the primary frame configuration. These spring assemblies are intended to reduce the loads exerted on the gap driving mechanisms, and also to suppress the deformation of the girders as the magnet supporting members.

PRIOR ART DOCUMENTS

Patent Documents

Patent Document 1: U.S. Pat. No. 7,956,557 B1

Non-Patent Document 1: Winick, Herman; George Brown; Klaus Halbach; John Harris (May 1981). "Synchrotron Radiation Wiggler and Undulator Magnets" Physics Today, May 1981, Volume 34, Issue 5, pp. 50-63

SUMMARY OF THE INVENTION

Problems to be Solved by the Invention

However, the structure disclosed in Patent Document 1 has problems as follows. Namely, the gap driving mechanisms mounted on the primary C-frame configuration are configured to be directly coupled to the compensation spring mechanisms with the secondary C-frame configurations interposed therebetween. Therefore, moments induced by the compensation spring mechanisms may cause deformations of the gap driving mechanisms, and the deformations of the gap driving mechanisms may degrade the precise gap control. Accordingly, even though there are provided the compensation springs, their performance has not been exerted sufficiently. Further, the compensation springs are placed just above and just under the girders which support the magnet arrays and, furthermore, the secondary C-frame configurations are provided just above and just under these compensation springs. This structure also has the problem of increases in size in the upward and downward directions.

The present invention has been made in view of the aforementioned circumstance and aims at providing an insertion device capable of preventing moments induced by compensation spring mechanisms from influencing precise gap driving and also capable of inhibiting the increase in size of the device.

Means for Solving the Problems

In order to solve the above problem, an insertion device according to the present invention comprising:

a first magnet array comprising a plurality of magnets placed in an array;

a first magnet supporting member adapted to support the first magnet array mounted to the first magnet supporting member;

a second magnet array comprising a plurality of magnets placed in an array and being faced to the first magnet array with a gap interposed therebetween;

a second magnet supporting member adapted to support the second magnet array mounted to the second magnet supporting member;

a gap driving mechanism for driving the first magnet supporting member and/or the second magnet supporting member in a direction in which the magnet arrays are faced to each other, in order to change a size of the gap;

a first coupling beam coupled integrally to the first magnet supporting member;

a second coupling beam coupled integrally to the second magnet supporting member;

a driving conjunction mechanism for coupling at least one of the first coupling beam and the second coupling beam to the gap driving mechanism;

a compensation spring mechanism adapted to act in such a direction as to cancel an attractive force acting between the first magnet array and the second magnet array; and a spring conjunction mechanism for coupling the compensation spring mechanism and the coupling beams to each other, wherein the spring conjunction mechanism includes:

a first spring supporting frame coupled, through a first coupling portion, to one of the first coupling beam and the second coupling beam, a second spring supporting frame coupled, through a second coupling portion, to the other one of the first coupling beam and the second coupling beam, and a guide mechanism for guiding relative movement of the first spring supporting frame and the second spring supporting frame, in the direction in which the magnet arrays are faced to each other, the compensation spring mechanism is mounted to both the first spring supporting frame and the second spring supporting frame and, when the size of the gap is changed, the first spring supporting frame and the second spring supporting frame move relative to each other in the direction in which the magnet arrays are faced to each other, so that the compensation spring mechanism operates.

With the insertion device having the aforementioned structure, it is possible to provide effects and advantages as follows. The first magnet supporting member is integrally coupled to the first coupling beam, and the second magnet supporting member is integrally coupled to the second coupling beam. The gap driving mechanism drives at least one of the first coupling beam and the second coupling beam for changing the size of the gap. On the other hand, the spring conjunction mechanism includes the first spring supporting frame and the second spring supporting frame, which are coupled to one and the other one of the first coupling beam and the second coupling beam, through the first coupling portion and the second coupling portion, respectively. Further, the first spring supporting frame and the second spring supporting frame are allowed to move relative to each other, through the guide mechanism, in the direction in which the magnet arrays are faced to each other. With this structure, moments induced by the operations of the compensation spring mechanism can be received by the guide mechanism, which inhibits such moments from influencing the gap driving mechanism through the first and second coupling portions. This can prevent the operations of the compensation spring from influencing the precise gap driving.

Further, the direction in which the magnet arrays are faced to each other depends on the state where the magnet arrays are installed. The direction in which the magnet arrays are faced to each other includes the vertical direction, the horizontal direction and arbitrary oblique directions, for example. Further, movements in the direction in which the magnet arrays are faced to each other include both cases where the magnet arrays get closer to each other and cases where the magnet arrays get farther away from each other.

Further, "the compensation spring mechanism is mounted to both the first spring supporting frame and the second spring supporting frame" means that the compensation spring mechanism is mounted at a portion thereof to the first spring supporting frame and, further, the compensation spring mechanism is mounted at another portion thereof to the second spring supporting frame.

In the present invention, preferably, one of the first spring supporting frame and the second spring supporting frame includes a pair of first plate portions, and a plate coupling portion which is provided on the first plate portions in their sides farther from the magnet arrays and is adapted to couple the first plate portions to each other, in a plan view, the first plate portions are coupled, at their sides closer to the magnet arrays, to one of the first coupling beam and the second coupling beam, through the first coupling portion, the other one of the first spring supporting frame and the second spring supporting frame includes a second plate portion placed in such a way as to be sandwiched between the pair of the plate portions in a plan view, the second plate portion is coupled, at its side closer to the magnet arrays, to the other one of the first coupling beam and the second coupling beam, through the second coupling portion, and the guide mechanism is provided between the plate coupling portion and a side of the second plate portion which is farther from the magnet arrays.

With this structure, the pair of the first plate portions and the plate coupling portion form a portal shape in a plan view (a top view), and the second plate portion is placed in such a way as to be sandwiched between the pair of the first plate portions. Namely, the plate portions have a three-layer configuration. The guide mechanism is provided between the plate coupling portion and the second plate portion in the side farther from the magnet arrays. Accordingly, even though the compensation spring mechanism makes an attempt to exert moments on the first and second coupling portions, these moments can be absorbed by the guide mechanism, which can inhibit the moments induced by the compensation spring from being exerted on the first and second coupling portions. This can prevent the operations of the compensation spring from influencing the precise gap driving, more effectively.

In the present invention, preferably, one of the first spring supporting frame and the second spring supporting frame includes a pair of first plate portions, and a plate coupling portion which is provided on the first plate portions in their sides farther from the magnet arrays and is adapted to couple the first plate portions to each other, in a plan view, the first plate portions are coupled, at their sides closer to the magnet arrays, to one of the first coupling beam and the second coupling beam, through the first coupling portion, the other one of the first spring supporting frame and the second spring supporting frame includes a second plate portion placed in such a way as to be sandwiched between the pair of the plate portions in a plan view, the second plate portion is coupled, at its side closer to the magnet arrays, to the other one of the first coupling beam and the second coupling beam, through the second coupling portion, and the guide mechanism is provided between the sides of the first plate portions which are farther from the magnet arrays, and a side of the second plate portion which is farther from the magnet arrays.

With this structure, the guide mechanism is provided between the sides of the first plate portions which are farther from the magnet arrays, and the side of the second plate portion which is farther from the magnet arrays. Accordingly, even though the compensation spring mechanism makes an attempt to exert moments on the first and second coupling portions, these moments can be absorbed by the guide mechanism, which can inhibit the moments induced by the compensation spring from being exerted on the first and second coupling portions.

In the present invention, preferably, one of the first spring supporting frame and the second spring supporting frame includes a first plate portion in a plan view, the first plate portions is coupled, at its side closer to the magnet arrays, to one of the first coupling beam and the second coupling beam, through the first coupling portion, the other one of the first spring supporting frame and the second spring supporting frame includes a second plate portion placed in such a way as to be faced to the first plate portion in a plan view, the second plate portion is coupled, at its side closer to the magnet arrays, to the other one of the first coupling beam and the second coupling beam, through the second coupling portion, and the guide mechanism is provided between a surface of the first plate portion in its side farther from the magnet arrays and a surface of the second plate portion in its side farther from the magnet arrays which are faced to each other.

With this structure, the first plate portion and the second plate portion are placed in such a way as to be faced to each other. Namely, the plate portions have a two-layer configuration. The guide mechanism is provided between the first plate portion and the second plate portion in the side farther from the magnet arrays. Accordingly, even though the compensation spring mechanism makes an attempt to exert moments on the first and second coupling portions, these moments can be absorbed by the guide mechanism, which can inhibit the moments induced by the compensation spring from being exerted on the first and second coupling portions.

Preferably, the first coupling portion and the second coupling portion according to the present invention have a structure for coupling through a combination of a shaft and a fitting hole fittable to the shaft.

Due to the combination of the shaft and the fitting hole, even if moments induced by the compensation spring are exerted on the first and second coupling portions, the shaft and the fitting hole are allowed to rotate relative to each other, which can inhibit the moments induced by the compensation spring from influencing the gap driving.

In the present invention, preferably, one of the first spring supporting frame and the second spring supporting frame is provided with a placement portion adapted to place, thereon, a compensation spring in the compensation spring mechanism, and the other one of the first spring supporting frame and the second spring supporting frame is provided with a compressive-force exertion portion adapted to exert a compressive force on the compensation spring.

With this structure, the spring force of the compensation spring can be changed, through relative movement of the compressive-force exertion portion. Further, the compensation spring mechanism can be properly placed.

Preferably, the spring conjunction mechanism according to the present invention further comprises a fixed frame secured to a foundation, and a plurality of the guide mechanisms, and the spring conjunction mechanism comprises:

a first guide mechanism adapted to guide the first spring supporting frame relative to the fixed frame in the direction in which the magnet arrays are faced to each other, and a second guide mechanism adapted to guide the second spring supporting frame relative to the fixed frame in the direction in which the magnet arrays are faced to each other, and when the size of the gap is changed, the spring conjunction mechanism is adapted to allow the first spring supporting frame and the second spring supporting frame to move relative to the fixed frame, in the direction in which the magnet arrays are faced to each other.

The first spring supporting frame and the second spring supporting frame can be adapted to move relative to each other in the direction in which the magnet arrays are faced to each other, and the fixed frame secured to the foundation can be provided, such that the first spring supporting frame and the second spring supporting frame can be each moved with respect to the fixed frame. With this structure, it is possible to maintain the spring conjunction mechanism at a stabilized state, due to the provision of the fixed frame.

In the present invention, preferably, the second coupling portion is provided on the first coupling beam in its side closer to the first magnet array, and the first coupling portion is provided on the second coupling beam in its side closer to the second magnet array.

Since the first coupling portion and the second coupling portion are placed in the side as close as possible to the magnet arrays, it is possible to inhibit the increase of the size of the spring conjunction mechanism in the upward and downward direction, which can also contribute to weight reduction.

In the present invention, preferably, the spring conjunction mechanism is placed in the rear side with respect to the magnet arrays, in a side view. This enables accessing the magnet arrays from the front side when viewed from the front surface side. Further, this prevents the existence of the spring conjunction mechanism from obstructing maintenances and the like.

A compensation module for use in an insertion device, the insertion device comprising:

a first magnet array comprising a plurality of magnets placed in an array;

a first magnet supporting member adapted to support the first magnet array mounted to the first magnet supporting member;

a second magnet array comprising a plurality of magnets placed in an array and being faced to the first magnet array with a gap interposed therebetween;

a second magnet supporting member adapted to support the second magnet array mounted to the second magnet supporting member;

a gap driving mechanism for driving the first magnet supporting member and/or the second magnet supporting member in a direction in which the magnet arrays are faced to each other, in order to change a size of the gap;

a first coupling beam coupled integrally to the first magnet supporting member;

a second coupling beam coupled integrally to the second magnet supporting member; and a driving conjunction mechanism for coupling at least one of the first coupling beam and the second coupling beam to the gap driving mechanism, the compensation module comprising:

a compensation spring mechanism adapted to act in such a direction as to cancel an attractive force acting between the first magnet array and the second magnet array; and a spring conjunction mechanism for coupling the compensation spring mechanism and the coupling beams to each other, wherein the spring conjunction mechanism includes:

a first spring supporting frame coupled, through a first coupling portion, to one of the first coupling beam and the second coupling beam, a second spring supporting frame coupled, through a second coupling portion, to the other one of the first coupling beam and the second coupling beam, and a guide mechanism for guiding relative movement of the first spring supporting frame and the second spring supporting frame, in the direction in which the magnet arrays are faced to each other, and the compensation spring mechanism is mounted to both the first spring supporting frame and the second spring supporting frame and, when the size of the gap is changed, the first spring supporting frame and the second spring supporting frame move relative to each other in the direction in which the magnet arrays are faced to each other, so that the compensation spring mechanism operates.

The compensation module according to the present invention can be applied not only to the insertion device according to the present invention, but also to various types of insertion devices which have been conventionally well known, particularly to insertion devices adapted to exert large attractive forces between magnet arrays, thereby causing the exertion of these attractive forces to adversely influence precise gap driving and magnetic-field intensity distributions in the direction of an electron beam. By applying the compensation module according to the present invention to such insertion devices, it is possible to realize precise gap driving and desired magnetic-field intensity distributions. Namely, in an insertion device having the aforementioned structure, the first spring supporting frame and the second spring supporting frame in the compensation module according to the present invention are coupled to one and the other one of the first coupling beam and the second coupling beam in the insertion device having the aforementioned structure, through the first coupling portion and the second coupling portion, respectively. In this case, the first spring supporting frame and the second spring supporting frame are allowed to move relative to each other, in the direction in which the magnet arrays are faced to each other. With this structure, moments induced by the operations of the compensation spring mechanism can be received by the guide mechanism, which inhibits such moments from influencing the gap driving mechanism through the first and second coupling portions. This can prevent the operations of the compensation spring from influencing the precise gap driving, which can realize precise gap driving and a desired magnetic-field intensity distribution in the insertion device having the aforementioned structure.

Further, the compensation module according to the present invention can also be applied to existing insertion devices having the aforementioned structure, as well as can be applied as portions of insertion devices to be newly fabricated. This can improve the gap driving and the magnetic-field intensity distribution in the insertion device.

Preferably, the compensation module according to the present invention comprising:

a pair of first plate portions, and a plate coupling portion which is provided on the first plate portions in their sides farther from the magnet arrays and is adapted to couple the first plate portions to each other, in a plan view, the first plate portions and the plate coupling portion being provided in one of the first spring supporting frame and the second spring supporting frame;

a second plate portion placed in such a way as to be sandwiched between the pair of the plate portions in a plan view, the second plate portion being provided in the other one of the first spring supporting frame and the second spring supporting frame; and the guide mechanism provided between the plate coupling portion and a side of the second plate portion which is farther from the magnet arrays.

Preferably, the compensation module according to the present invention comprising:

a pair of first plate portions, and a plate coupling portion which is provided on the first plate portions in their sides farther from the magnet arrays and is adapted to couple the first plate portions to each other, in a plan view, the first plate portions and the plate coupling portion being provided in one of the first spring supporting frame and the second spring supporting frame;

a second plate portion placed in such a way as to be sandwiched between the pair of the plate portions in a plan view, the second plate portion being provided in the other one of the first spring supporting frame and the second spring supporting frame; and the guide mechanism provided between the sides of the first plate portions which are farther from the magnet arrays, and a side of the second plate portion which is farther from the magnet arrays.

Preferably, the compensation module according to the present invention comprising:

a first plate portion provided in one of the first spring supporting frame and the second spring supporting frame;

a second plate portion placed in such a way as to be faced to the first plate portion in a plan view, the second plate portion being provided in the other one of the first spring supporting frame and the second spring supporting frame; and the guide mechanism provided between a surface of the first plate portion in its side farther from the magnet arrays and a surface of the second plate portion in its side farther from the magnet arrays which are faced to each other.

With the structures of these compensation modules, moments which the compensation spring mechanism exerts on the first and second coupling portions can be absorbed by the guide mechanism, which can inhibit the moments induced by the compensation spring from being exerted on the first and second coupling portions. This can prevent the operations of the compensation spring from influencing the precise gap driving, more effectively.

MODE FOR CARRYING OUT THE INVENTION

Figure 1:
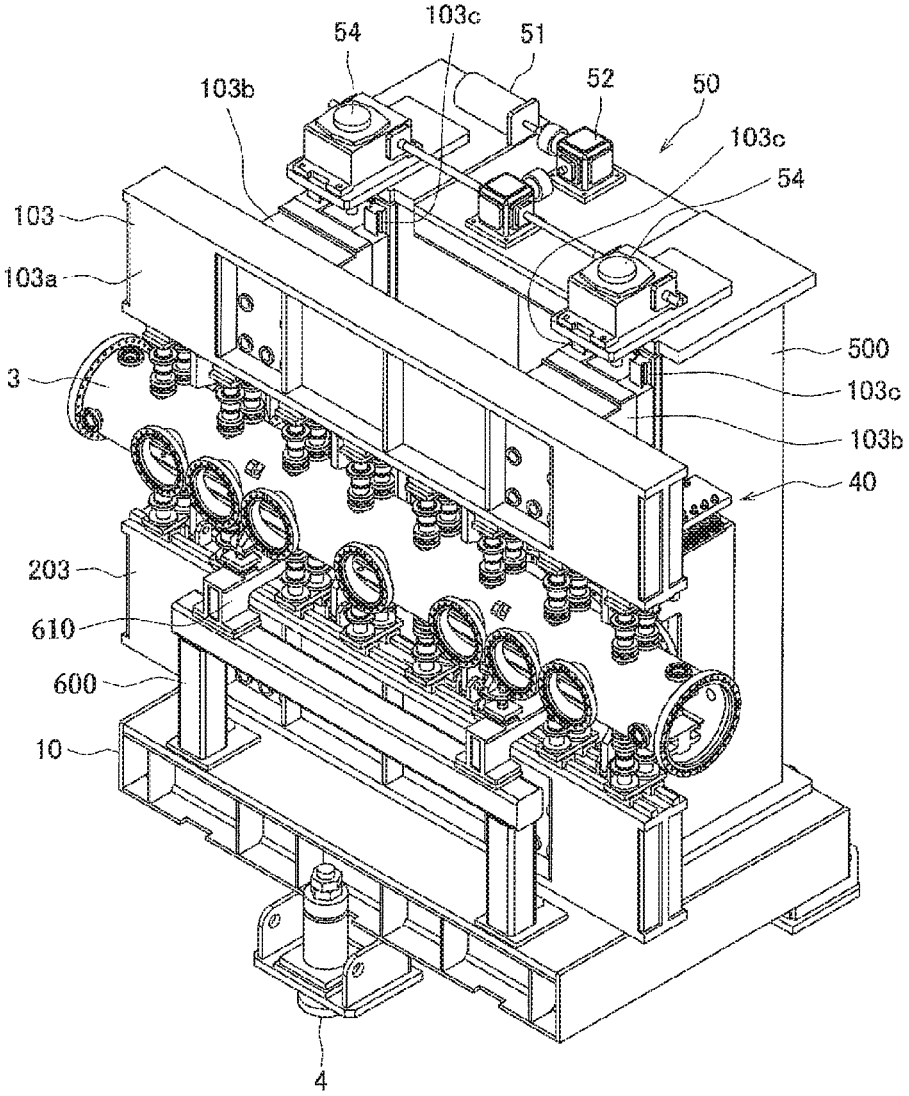
FIG. 1 is a perspective view of an insertion device according to a first embodiment, from a front surface side.
Figure 2:
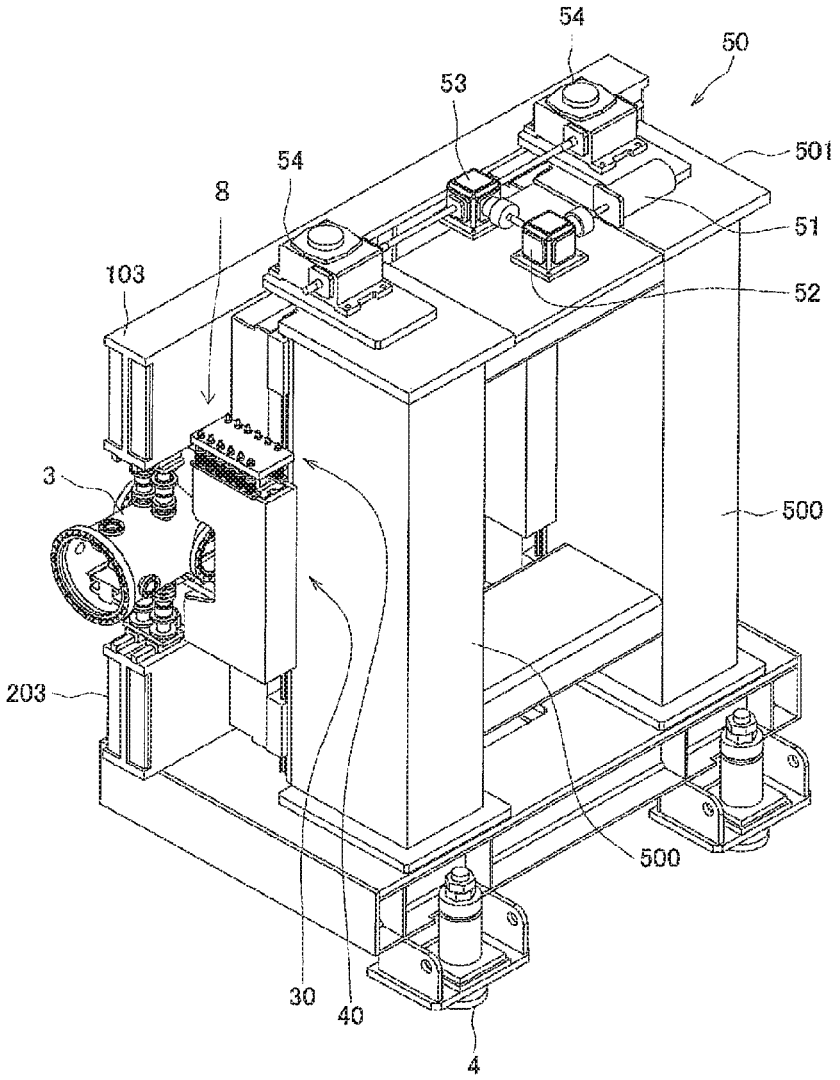
FIG. 2 is a perspective view of the insertion device according to the first embodiment, from a rear surface side.
Figure 3:
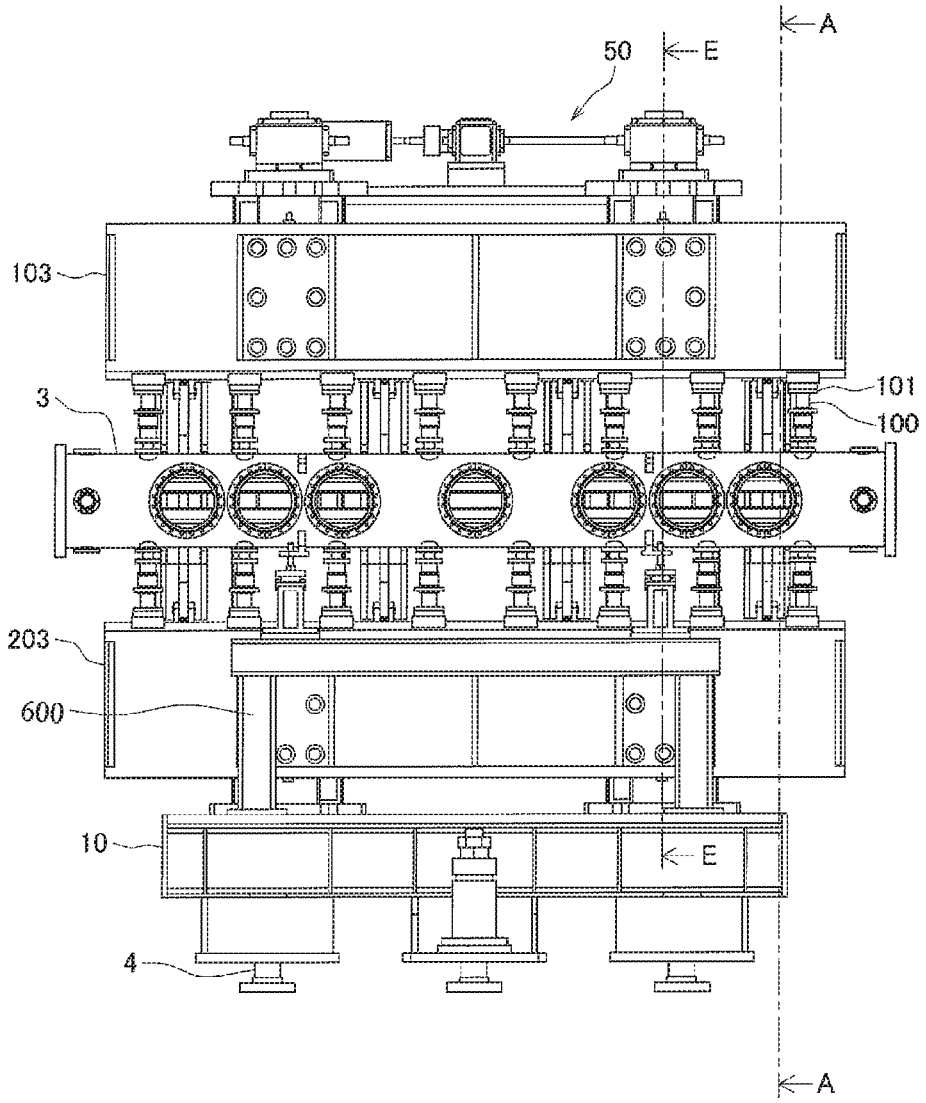
FIG. 3 is a front view of the insertion device according to the first embodiment.
Figure 4:
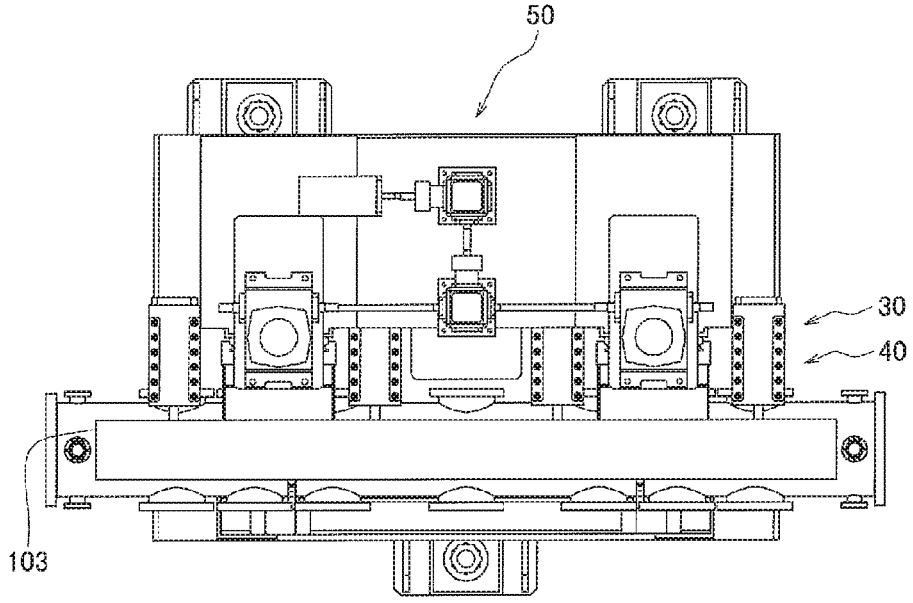
FIG. 4 is a plan view of the insertion device according to the first embodiment, from above.
Figure 5A:
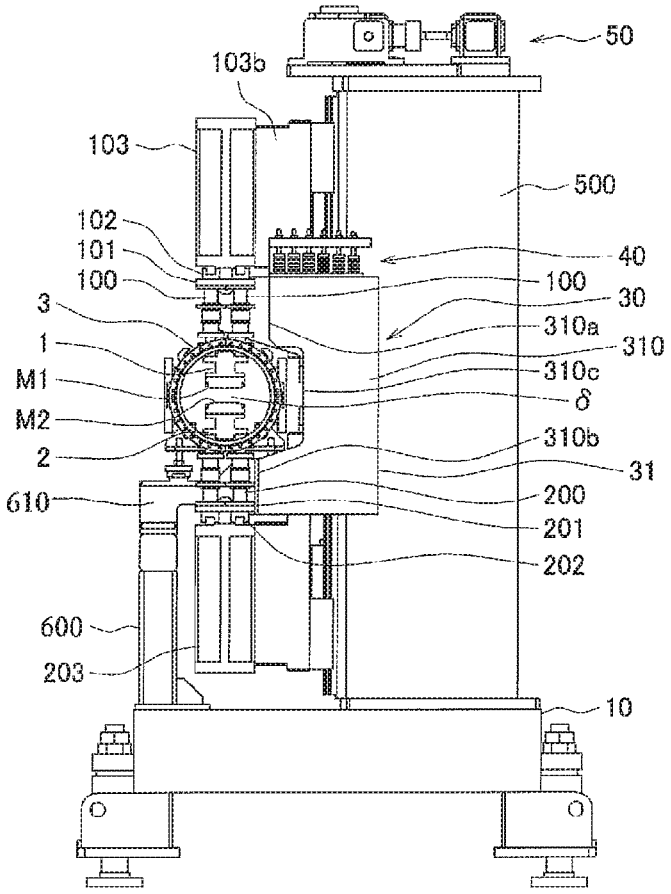
FIG. 5A is a side view of the insertion device according to the first embodiment.
Figure 5B:
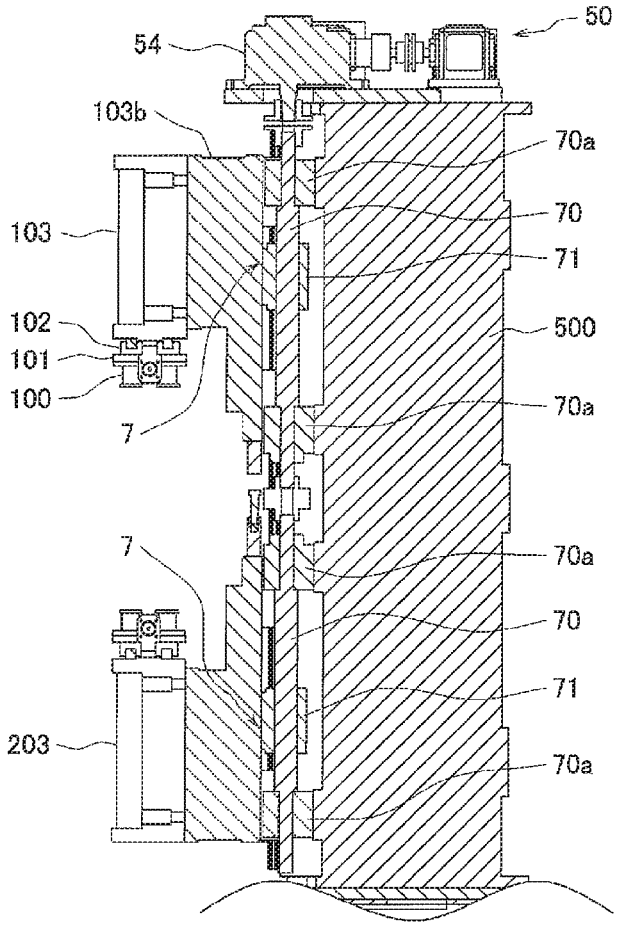
FIG. 5B is a cross-sectional view taken along E-E in FIG. 3.
Figure 6:
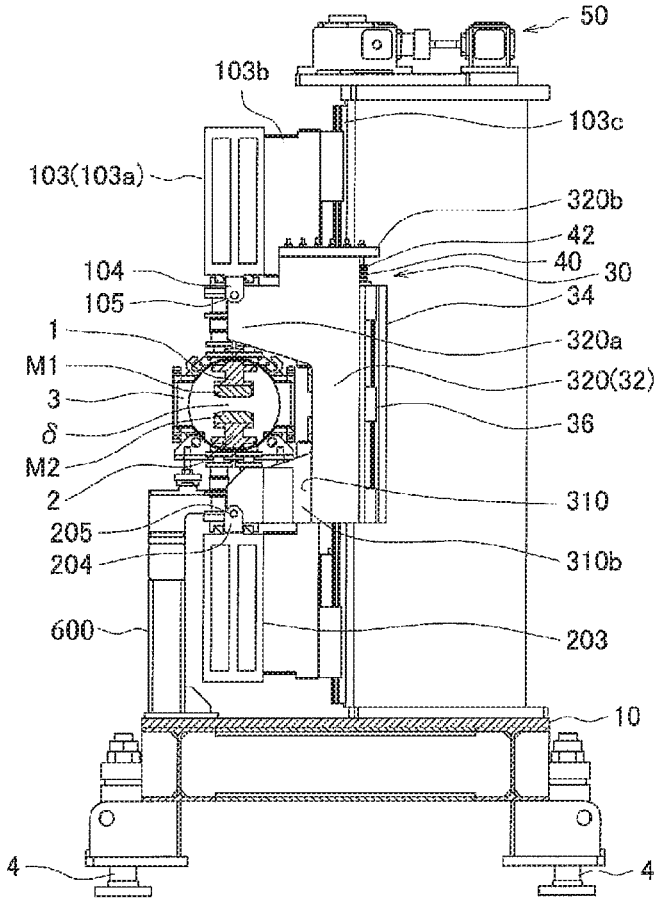
FIG. 6 is a view taken along an arrow A-A in FIG. 3.

A preferred embodiment (a first embodiment) of an insertion device according to the present invention will be described, with reference to FIGS. 1 to 6. FIG. 1 is a perspective view of the insertion device according to the present embodiment, from the front surface side. FIG. 2 is a perspective view of the same from the rear surface side. FIG. 3 is a front view of the same. FIG. 4 is a plan view of the same when viewed from above. FIG. 5A is a side view of the same when viewed from the right side. FIG. 5B is a cross-sectional view taken along E-E in FIG. 3 (wherein a vacuum vessel and peripheral portions therearound are not illustrated). FIG. 6 is a view taken along an arrow A-A in FIG. 3.

As illustrated in FIG. 5A, the insertion device includes a first magnet array M1 constituted by a plurality of magnets placed in an array, and a second magnet array M2 constituted by a plurality of magnets placed in an array similarly, which are faced to each other with a gap δ interposed therebetween. An electron beam passes through this gap space. Further, as the magnet arrays, it is possible to employ various types of examples of structures, such as ones disclosed in JP-A-2001-143899 and JP-A-2014-13658, as well as one disclosed in Non-Patent Document 1, for example. Accordingly, the magnet arrays are not limited to particular placement of magnets.

The first magnet array M1 is supported by a first magnet supporting member 1, and the second magnet array M2 is supported by a second magnet supporting member 2. For example, each of the magnets constituting the first magnet array M1 is coupled to the first magnet supporting member 1, through bolts and the like. The same applies to the second magnet array M2.

Further, the magnetic arrays, which are the first magnet array M1 and the second magnet array M2, are faced to each other in the vertical direction. However, the insertion device is not limited to the aforementioned structure and can also include magnet arrays in a horizontal direction or in an oblique direction or a combination of magnet arrays in two or more directions.

The first magnet array M1 and the second magnet array M2 are installed inside a vacuum vessel 3 which is interiorly maintained at ultra-high vacuum. The vacuum vessel 3 has a circular cylindrical shape, and also is shaped to be elongated along the leftward and rightward direction in the figure (the direction of propagation of the electron beam), as illustrated in FIGS. 1 and 3. Further, the gap δ can be changed in size through gap driving mechanisms, which will be described later. A base 10 is placed on a placement surface through a plurality of pedestals 4. An appropriate number of such pedestals 4 can be placed in the front and rear sides.

Further, the vacuum vessel 3 is supported on the base 10 through a supporting body 600. As also illustrated in FIG. 5A, a supporting member 610 is provided on the supporting body 600, thereby receiving the lower portion of the vacuum vessel 3. The supporting body 600, the supporting member 610 and the vacuum vessel 3 are coupled to each other through mechanical means (for example, bolts and nuts) which are not illustrated. Further, the supporting body 600 is also coupled to the base 10 through appropriate mechanical means (for example, bolts and nuts).

Coupling shafts 100 are mounted to an upper portion of the first magnet supporting member 1, and the coupling shafts 100 are coupled at their upper ends to coupling plates 101. As illustrated in FIG. 3, eight coupling shafts 100 are placed along the leftward and rightward direction, and eight coupling plates 101 are placed similarly. As illustrated in FIG. 5A, two coupling shafts 100 are placed along the forward and rearward direction when viewed from the front surface side, and these two coupling shafts 100 are coupled to each other through a single coupling plate 101. Namely, in the example illustrated in FIGS. 3 and 5A, a total of 16 coupling shafts 100 are placed, and the respective two of these 16 coupling shafts 100 are coupled to each other through the eight coupling plates 101.

A first coupling beam 103 is placed above the placement of the coupling shafts 100. The first coupling beam 103 and the coupling plates 101 are coupled to each other, through a magnet supporting member guide mechanism 102 such as a linear guide. This is provided for absorbing the change of the length of the first magnet supporting member 1, if the first magnet supporting member 1 changes in length in the horizontal direction due to thermal expansion thereof. Accordingly, the gap driving mechanism and the driving conjunction mechanism are prevented from being influenced by the thermal expansion. As described above, the first magnet supporting member 1 and the first coupling beam 103 are integrally coupled to each other. If the first coupling beam 103 moves in the vertical direction (an example of the direction in which the magnet arrays are faced to each other: the same applies to the following), the first magnet supporting member 1 also moves in the vertical direction integrally therewith, in conjunction with the first coupling beam 103. They move in the vertical direction by the same amount. Further, the mechanism for integrally coupling the first coupling beam 103 and the first magnet supporting member 1 to each other is not limited to the aforementioned structure, and various examples of modifications can be applied thereto.

The second magnet supporting member 2 is also integrally coupled to a second coupling beam 203, through coupling shafts 200, coupling plates 201, and a magnet supporting member guide mechanism 202. The structure thereof is the same as that for the first coupling beam 103 and is not described herein. The same applies to the following description.

As illustrated in FIG. 1, the first coupling beam 103 includes a main-body frame 103*a* having a rectangular parallelepiped shape extending along the leftward and rightward direction. Further, supporting frames 103*b* are coupled, at two positions, to the rear side of the main-body frame 103*a* and are extended along the forward and rearward direction when viewed from the front surface side.

<The Gap Driving Mechanisms>

There is provided the gap driving mechanism 50 for changing the size of the aforementioned gap δ, in an upper portion of the rear portion of the insertion device. The gap driving mechanism 50 is installed on the base 10 with frames 500 interposed therebetween. As illustrated in FIG. 2, the frames 500 have a rectangular parallelepiped shape with a rectangular cross section in the horizontal direction, and there are provided two such frames 500. A placement plate 501 is provided on the upper portions of the frames 500, and the gap driving mechanism 50 is placed thereon.

The gap driving mechanism 50 includes a driving motor 51, and conversion portions 52, 53 and 54. The conversion portion 52 converts the driving transmission direction by 90 degrees. The conversion portion 53 converts the driving transmission direction and transmits the motive power such that it diverges leftwardly and rightwardly. There are provided a pair of the conversion portions 54 in the left and right sides which are adapted to convert the driving in the horizontal direction into driving in the vertical direction. The concrete structure thereof is constituted by known mechanical elements such as bevel gears.

The conversion portions 54 convert the driving transmission into driving transmission in the vertical direction, which drives ball screw mechanisms 7 including a vertical shaft, as illustrated in FIG. 5B, for example. The ball screw mechanisms 7 are a well-known structure and are constituted by respective screw shaft portions 70 and respective nut portions 71. The screw shaft portions 70 are supported at their upper and lower sides by bearings 70*a*, and the bearings 70*a* are mounted to the frames 500. The nut portions 71 are mounted to the supporting frames 103*b*. Further, in FIG. 5B, the vacuum vessel 3 and peripheral portions therearound are not illustrated.

By driving the ball screw mechanisms 7, the screw shaft portions 70 are rotated, thereby moving the nut portions 71 upwardly and downwardly. This can move the first coupling beam 103 in the vertical direction. There are provided the supporting frames 103*b* (see FIG. 1), in order to move the first coupling beam 103 in the vertical direction. When viewed from the front surface side, the supporting frames 103*b* are mounted at their rear sides to the front sides of the frames 500 when viewed from the front surface side, through two frame guide mechanisms 103*c*. When viewed from the front surface side, the supporting frames 103*b* are mounted, at their front sides, to the first coupling beam 103.

The ball screw mechanisms 7, which are driven by the frame guide mechanisms 103*c* and the conversion portions 54 as described above, correspond to a driving conjunction mechanism for coupling the first coupling beam 103 and the gap driving mechanism 50 to each other. By driving the driving motor 51, the first coupling beam 103 can be moved in the vertical direction, thereby moving the first magnet supporting member 1 and the first magnet array M1 in the vertical direction. Namely, the size of the gap δ can be changed.

Further, the second coupling beam 203, which is positioned in the lower side, can also be moved in the vertical direction, similarly, through a gap driving mechanism (not illustrated) which is placed in the lower side. The structure thereof is basically the same as that for the first coupling beam 103 and is not described herein. By moving the first coupling beam 103 and the second coupling beam 203 in the vertical direction using the aforementioned structure, it is possible to change the size of the gap δ. By moving the first coupling beam 103 and the second coupling beam 203 in such a direction that they get closer to each other, the gap δ can be made smaller. By moving them in such a direction that they get farther away from each other, the gap δ can be made larger.

<Compensation Modules>

Figure 7A:
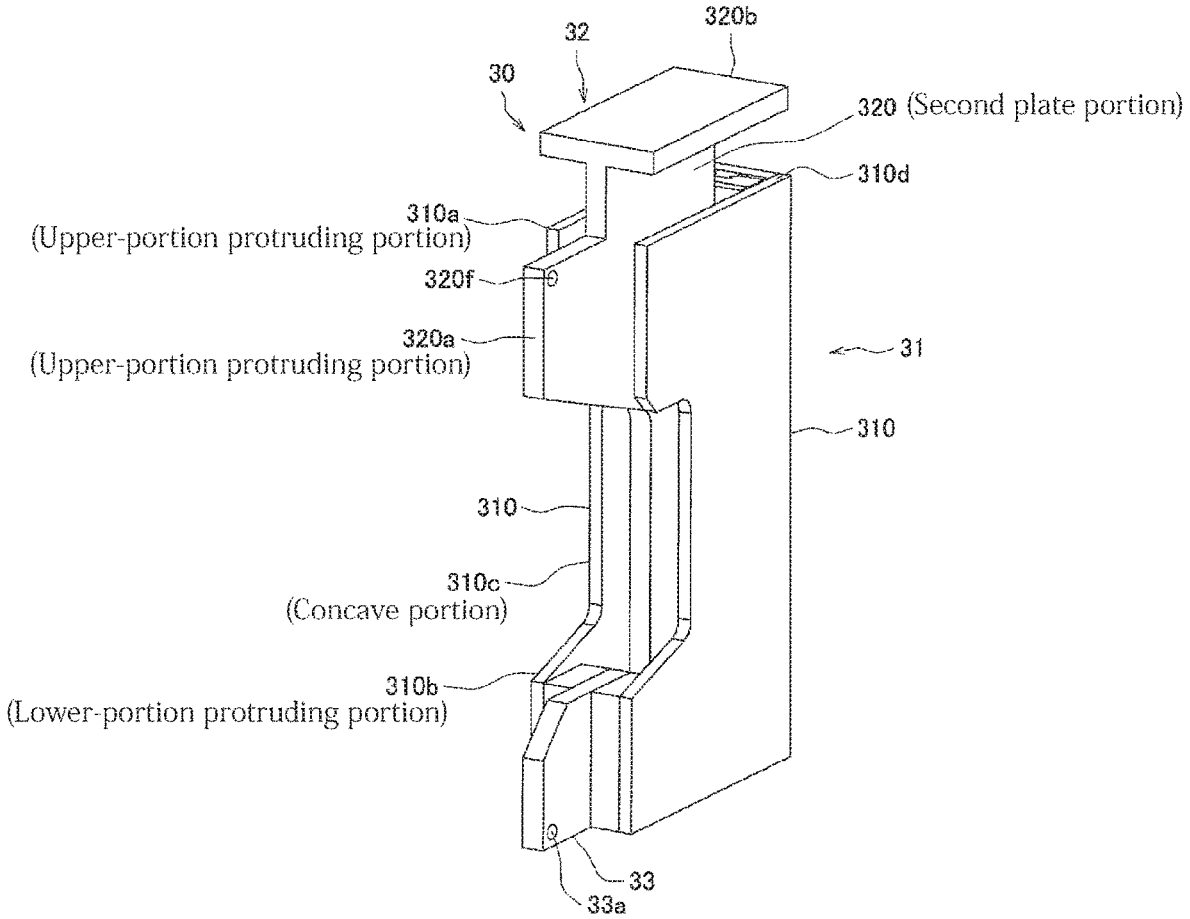
FIG. 7A is a schematic view briefly illustrating the structure of a spring conjunction mechanism and is a perspective view of the same from the front surface side.
Figure 7B:
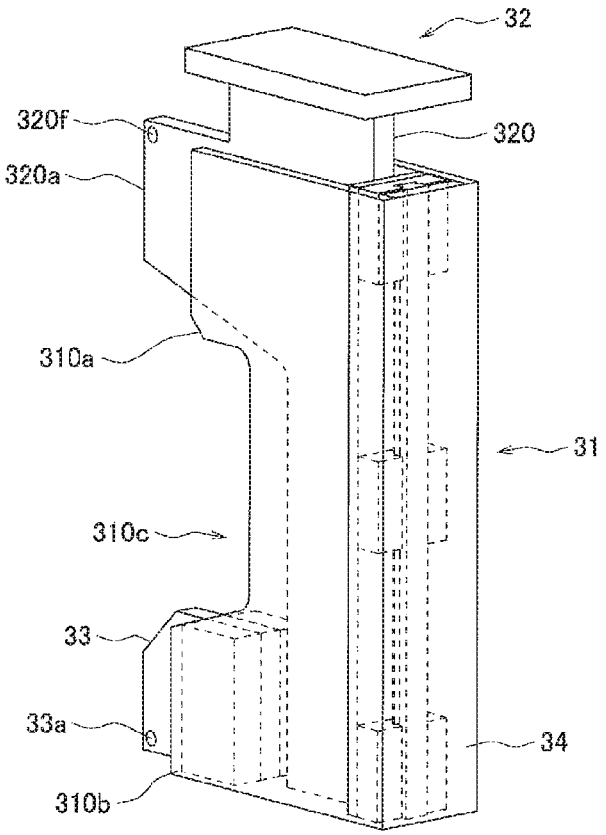
FIG. 7B is a perspective view illustrating the structure of the spring conjunction mechanism from the rear-surface side.
Figure 7C:
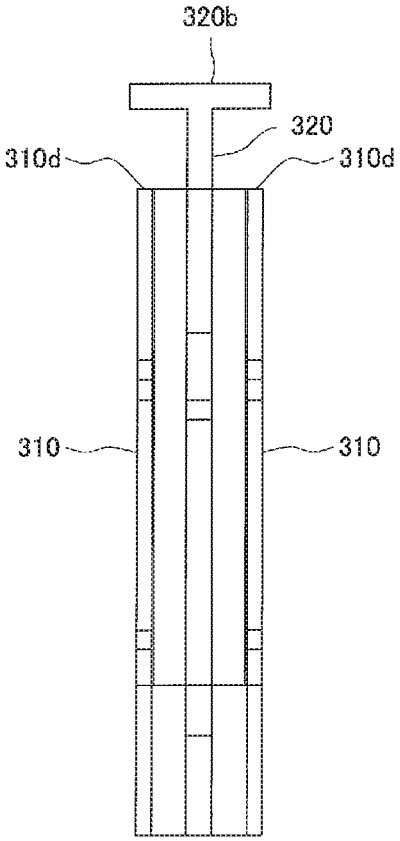
FIG. 7C is a front view of the spring conjunction mechanism.
Figure 7D:
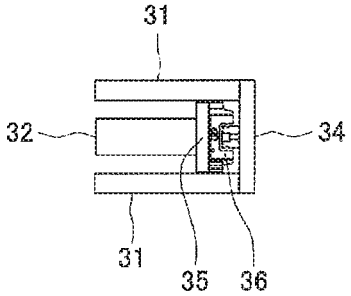
FIG. 7D is a horizontal cross-sectional view of the center portion of the structure of the spring conjunction mechanism.

Next, as a preferred embodiment of compensation modules according to the present invention, there will be described, at first, a spring conjunction mechanism 30, out of compensation spring mechanisms 40 and spring conjunction mechanisms 30 which constitute compensation modules 8, with reference to FIGS. 7A, 7B, 7C and 7D. FIG. 7A is a schematic view simply illustrating the structure of the spring conjunction mechanism 30, which is a perspective view illustrating the same from the front-surface side. FIG. 7B is a perspective view illustrating the same from the rear-surface side. FIG. 7C is a front view of the same. FIG. 7D is a horizontal cross-sectional view of the center portion in a plan view (a top view) (a horizontal cross-sectional view of the center portion which is provided with a concave portion 310*c* in the spring conjunction mechanism 30).

The spring conjunction mechanism 30 is constituted by a first spring supporting frame 31, and a second spring supporting frame 32. The first spring supporting frame 31 includes a pair of first plate portions 310, and the thickwise direction thereof corresponds to the leftward and rightward direction. The first plate portions 310 are installed in such a way that the plates are erected in the vertical direction. The first plate portions 310 include an upper-portion protruding portion 310*a*, a lower-portion protruding portion 310*b*, and the concave portion 310*c* formed therebetween. As also illustrated in FIG. 5A, the concave portion 310*c* is shaped to secure a space for placing the vacuum vessel 3 therein. In the example of FIGS. 7A to 7C, the lower-portion protruding portion 310*b* is shaped to protrude forwardly (in the side closer to the magnet arrays) more than the upper-portion protruding portion 310*a*. However, the upper-portion protruding portion 310*a* and the lower-portion protruding portion 310*b* can also be shaped to protrude by the same amount. The lower-portion protruding portions 310*b* of the pair of the first plate portions 310 are coupled to each other through a coupling block 33 (see FIGS. 7A and 7B). A portion of the coupling block 33 is protruded forwardly more than the lower-portion protruding portions 310*b*, up to the same position as that of an upper-portion protruding portion 320*a* of a second plate portion which will be described later. Further, the coupling block 33 is a preferred example, and the effects of the present invention can also be provided by other examples of structures. For example, a portion corresponding to the coupling block 33 can also be formed integrally with the first plate portions 310.

The pair of the first plate portions 310 are integrally coupled to each other, at their rear-surface side (their sides farther from the magnet arrays), through a coupling plate 34 (which corresponds to a plate coupling portion).

The second spring supporting frame 32 includes a single second plate portion 320 and is installed in such a way that the plate is erected in the vertical direction. The second plate portion 320 is provided in its upper portion with the upper-portion protruding portion 320*a*, in its side closer to the magnet arrays. The upper-portion protruding portion 320*a* is protruded forwardly more than the upper-portion protruding portions 310*a*. As can also be seen from FIG. 7C, the second plate portion 320 is placed in such a way as to be sandwiched between the pair of the first plate portions 310, and they are placed with respective predetermined gaps interposed therebetween.

A placement plate 35 is placed on the rear side of the second plate portion 320, which is its side farther from the magnet arrays, and a guide mechanism 36 is placed between the placement plate 35 and the coupling plate 34. Incidentally, in the following description, the guide mechanism 36 will be referred to as a vertical guide mechanism 36, in order to distinguish it from guide mechanisms installed in other portions for facilitating understanding. However, it is not intended that the guide mechanism 36 should be installed restrictively in the vertical direction (see FIG. 7D). The vertical guide mechanism 36 can be constituted by a linear guide, for example, such that a guide rail therein is placed on the coupling plate 34, and a guide block therein is placed on the second plate portion 320. Further, the guide rail and the guide block can also be interchanged in placement. The vertical guide mechanism 36 can also be constituted by other guide mechanisms than linear guides. The vertical guide mechanism 36 corresponds to a guide mechanism for guiding the relative movement of the first spring supporting frame 31 and the second spring supporting frame 32 in the vertical direction (in which the magnet arrays are faced to each other).

With this structure, the first spring supporting frame 31 can be moved relative to the second spring supporting frame 32 in the vertical direction.

The first plate portions 310 are provided, at their upper end portions, with respective spring placement portions 310*d*. Further, the second plate portion 320 is provided at its upper end portion with a compressive-force exertion portion 320*b*. The compressive-force exertion portion 320*b* is formed to have a plate shape with a horizontal surface. Compensation springs are placed between the spring placement portions 310*d* and the compressive-force exertion portion 320*b*. Accordingly, the compressive-force exertion portion 320*b* also functions as a spring placement portion. Incidentally, the compensation spring mechanism is not illustrated in FIGS. 7A-7D.

Figure 8:
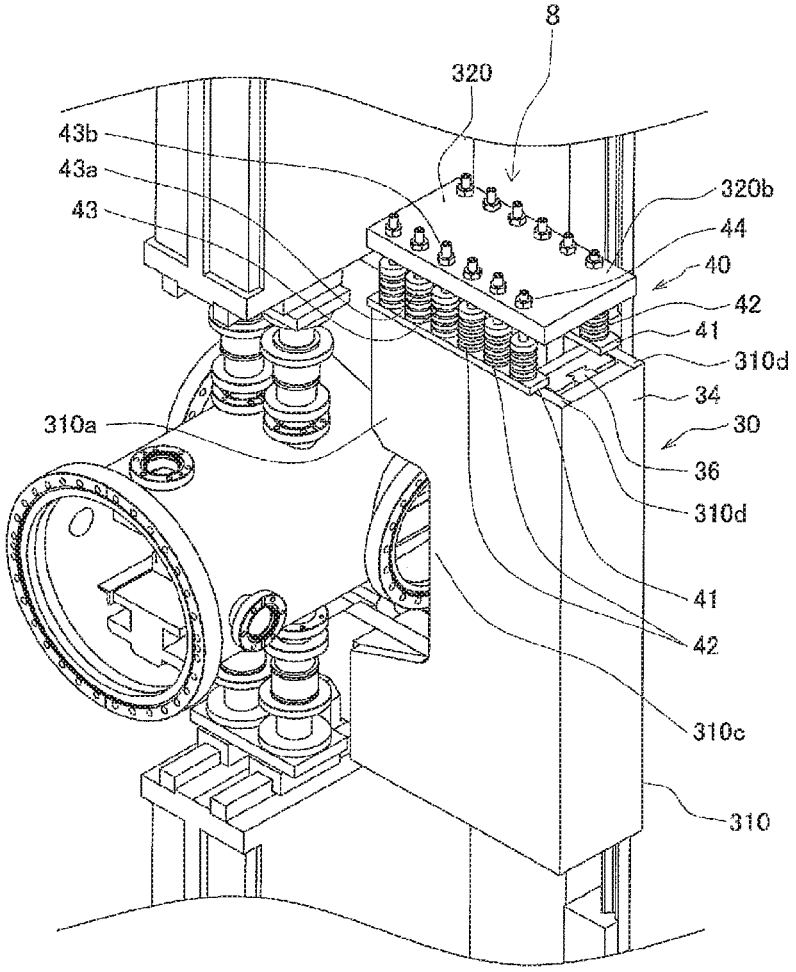
FIG. 8 is an enlarged perspective view illustrating a compensation module.

FIG. 8 is an enlarged perspective view illustrating a compensation module 8. There will be described the compensation spring mechanism 40 which constitutes the compensation module 8 together with the spring conjunction mechanism 30, with reference to FIG. 8. Spring installation plates 41 are provided on the upper surfaces of the spring placement portions 310*d*. A plurality of compensation springs 42 are installed on the spring installation plates 41. Six compensation springs 42 are placed in the forward and rearward direction when viewed from the front surface side. Incidentally, the number of the compensation springs placed thereon can be properly determined. As illustrated in the plan view of FIG. 4 which illustrates them from above, the compensation modules 8 (the spring conjunction mechanisms 30 and the compensation spring mechanisms 40) are placed at four positions in the leftward and rightward direction (the direction of propagation of the electron beam). The number of the compensation modules placed therein can be properly determined, depending on the length of the insertion device in the leftward and rightward direction. With respect to the compensation spring mechanism 40 at a single position, the compensation springs 42 are arranged in two rows (since there is the pair of the first plate portions 310), and there is a total of 12 compensation springs 42.

The compensation springs 42 are constituted by compression coil springs. The compensation springs 42 are placed at their lower end portions on the spring installation plates 41. Respective pushers 43 are placed on the upper end portions of the compensation springs 42. The pushers 43 are each constituted by a pressing portion 43*a* and a bolt portion 43*b*, which are integrally formed. The pressing portions 43*a* are structured to press the upper end portions of the compensation springs 42. The pushers 43 can be fastened to the compressive-force exertion portion 320*b*, through the bolt portions 43*b*. The pushers 43 can be positioned and secured through nuts 44. The amounts of initial compression of the respective compensation springs 42 can be adjusted, through the pushers 43.

Next, there will be described the structure for coupling the spring conjunction mechanism 30 to the first and second coupling beams 103 and 203. As illustrated in FIG. 6, the upper-portion protruding portion 320*a* of the second plate portion 320 is coupled, at its tip-end upper portion, to the first coupling beam 103. A coupling plate 104 is mounted to the lower-surface side of the first coupling beam 103, and the coupling plate 104 is coupled to the second plate portion 320 through a coupling shaft 105. The tip-end upper portion of the upper-portion protruding portion 320*a*, the coupling plate 104 and the coupling shaft 105 correspond to a second coupling portion. The second plate portion 320 (the second spring supporting frame 32) is allowed to rotate and move, rather than being completely secured to the first coupling beam 103.

The lower-portion protruding portions 310*b* of the first plate portions 310 are coupled, at their tip-end lower portions, to the second coupling beam 203, through the coupling block 33. A coupling plate 204 is mounted to the upper-surface side of the second coupling beam 203, and the coupling plate 204 is coupled to the first plate portions 310 through a coupling shaft 205. The tip-end lower portions of the lower-portion protruding portions 310*b*, the coupling block 33, the coupling plate 204 and the coupling shaft 205 correspond to a first coupling portion. The first plate portions 310 (the first spring supporting frame 31) are allowed to rotate and move, rather than being completely secured to the second coupling beam 203. As described above, the compensation spring mechanisms 40 and the first magnet supporting member 1 and the second magnet supporting member 2 are coupled to each other through the spring conjunction mechanisms 30, with various members such as the coupling beams 103 and 203 interposed therebetween. Further, in FIGS. 1 to 6 and 8, the compensation modules 8 are all installed in the rear side with respect to the magnet arrays (in the side closer to the frames 500 with respect to the vacuum vessel 3). However, the compensation modules 8 can also be installed in the front side (in the opposite side from the frames 500 with respect to the vacuum vessel 3) or can be installed in the opposite sides across the vacuum vessel 3, depending on the structure of the insertion device in which the compensation modules are installed and depending on the required sizes of the spring forces.

<Gap Changing Operations>

There will be described operations for changing the gap δ, with reference to FIGS. 6 and 8. Through the gap driving mechanisms 50, the first coupling beam 103 is moved downwardly, and the second coupling beam 203 is moved upwardly. Thus, the first magnet supporting member 1 and the first magnet array M1 are moved downwardly, and the second magnet supporting member 2 and the second magnet array M2 are moved upwardly. Consequently, the first magnet array M1 and the second magnet array M2 get closer to each other, thereby making the gap δ smaller. At the same time, the attractive force between the magnets is made larger.

Further, the second plate portion 320 is moved downwardly since the first coupling beam 103 is moved downwardly. Further, the first plate portions 310 are moved upwardly since the second coupling beam 203 is moved upwardly. As a result thereof, the compensation springs 42 in the compensation spring mechanisms 40 are compressed. As the gap δ is made smaller, the attractive force from the magnets is made larger and, in conjunction therewith, the spring forces in the compensation spring mechanisms 40 are made larger. If the attractive force is made larger, this exerts forces which attempt to deform the coupling beams, which are integrally coupled to the magnet supporting bodies supporting the magnet arrays. If the coupling beams are deformed, the magnet supporting bodies are also deformed, which makes the size of the gap δ non-constant in the rightward and leftward direction, which is the direction of the electron beam, thereby making it impossible to maintain the magnetic-field intensity distribution in the direction of the electron beam which has been initially set. For coping therewith, the compensation spring mechanisms 40 are provided, in order to suppress the deformations of the coupling beams due to attractive forces.

Along with the increase of the compressive forces of the compensation springs 42, respective moments in opposite directions may be exerted on the first coupling portion and the second coupling portion. These both moments are cancelled by the portion of the vertical guide mechanism 36. This prevents so large moments from being exerted on the first and second coupling portions. Further, in the present embodiment, the first and second coupling portions are constituted by coupling structures including a shaft and a fitting hole. Therefore, even if a residual moment is exerted thereon due to cancelling errors, the moment can be absorbed by slight relative rotation of the shaft and the fitting hole. This can inhibit moments induced by the compensation spring mechanisms 40 from adversely influencing the gap driving mechanisms 50, thereby preventing the accurate gap driving from being influenced thereby.

Further, in the present embodiment, the first and second coupling portions are provided on the upper end portion of the second coupling beam 203 and on the lower end portion of the first coupling beam 103, respectively. Namely, both of the first and second coupling portions are provided in the side closer to the magnet arrays. This can inhibit the increase of the sizes of the first spring supporting frame 31 and the second spring supporting frame 32 in the upward and downward direction. Further, the compensation spring mechanisms 40 are provided in the rear side with respect to the vacuum vessel 3 when viewed from the front surface side. When viewed from the front-surface side, the front side with respect to the vacuum vessel 3 is opened. This prevents the compensation spring mechanisms 40 from obstructing works which necessitate accessing the vacuum vessel 3 and the magnet arrays from the front side when viewed from the front surface side.

Further, regarding the respective elements constituting the spring conjunction mechanisms 30, it is possible to properly determine the materials thereof, the methods for fabricating them, and the constitutions of members therein, such as whether the respective elements are constituted by a single member or by a combination of plural members, for example. Further, the same applies to the structures of the plate portions, and the shapes thereof are not limited to complete plates (flat plates).

Second Embodiment

Figure 9A:
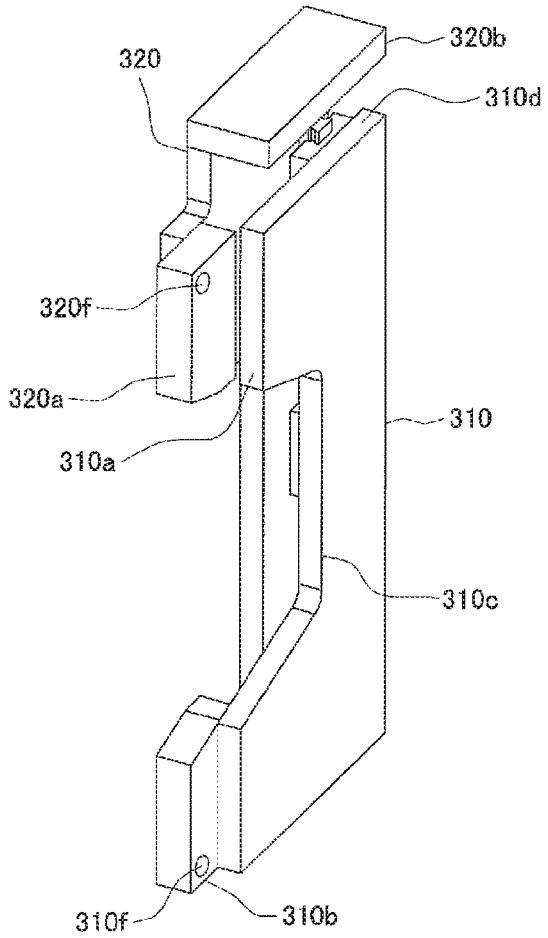
FIG. 9A is a perspective view of a spring conjunction mechanism according to a second embodiment, when viewed from the right side.
Figure 9B:
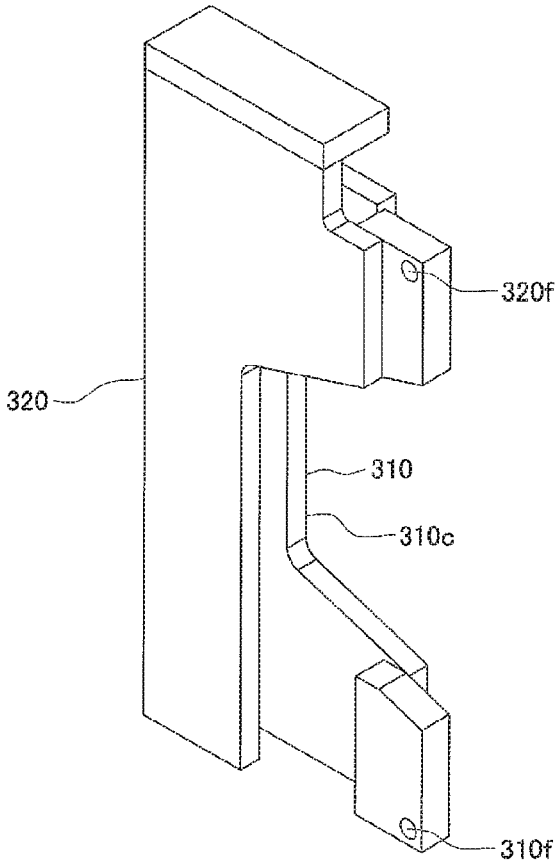
FIG. 9B is a perspective view of the spring conjunction mechanism according to the second embodiment, when viewed from the left side.
Figure 9C:
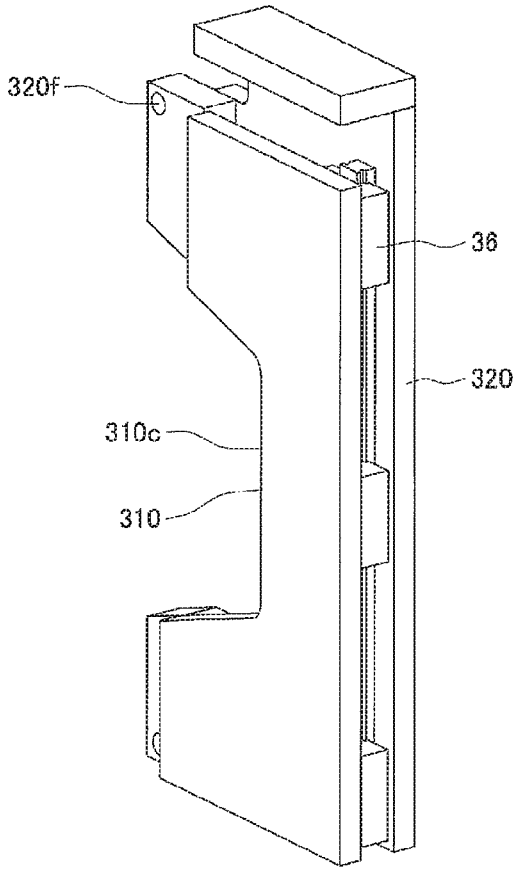
FIG. 9C is a perspective view of the spring conjunction mechanism according to the second embodiment, when viewed from the rear surface side.
Figure 9D:
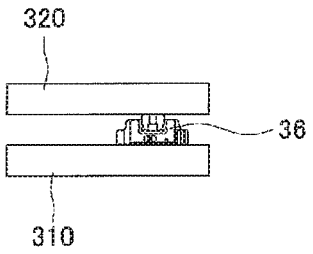
FIG. 9D is a horizontal cross-sectional view of the center portion of the spring conjunction mechanism according to the second embodiment.

Next, there will be described a second embodiment of the spring conjunction mechanisms 30, with reference to FIGS. 9A, 9B, 9C and 9D. FIG. 9A is a perspective view illustrating a spring conjunction mechanism according to the second embodiment, when viewed from the front surface side, from the right side and from above. FIG. 9B is a perspective view of the same when viewed from the front-surface side, from the left side and from above. FIG. 9C is a perspective view of the same when viewed from the rear surface side. FIG. 9D is a horizontal cross-sectional view of the center portion in a plan view (a top view) (a horizontal cross-sectional view of the center portion which is provided with a concave portion 310*c* in the spring conjunction mechanism 30). Further, in the following embodiments, the elements having the same functions as those of the first embodiment may be designated by the same reference characters as those of the first embodiment and will not be described in some cases.

In the present embodiment, a first spring supporting frame 31 is constituted by a single first plate portion 310. A second spring supporting frame 32 is constituted by a second plate portion 320, which is faced to the first plate portion 310 with a predetermined interval interposed therebetween. A vertical guide mechanism 36 is provided between their surfaces faced to each other. The vertical guide mechanism 36 is placed at a position in the side farther from magnet arrays. Similarly to the first embodiment, there are provided a spring placement portion 310*d* and a compressive-force exertion portion 320*b*, and compensation spring mechanisms 40 (not illustrated) are placed therebetween. The tip-end upper portion of an upper-portion protruding portion 320*a* provided in the side closer to the magnet arrays, a coupling plate 104 and a coupling shaft 105 correspond to a second coupling portion. The tip-end lower portion of a lower-portion protruding portion 310*b* provided in the side closer to the magnet arrays, a coupling plate 204 and a coupling shaft 205 correspond to a first coupling portion.

In the second embodiment, the plate portions have a two-layer configuration and have a simplified structure, which can also contribute to weight reduction.

Third Embodiment

Figure 10A:
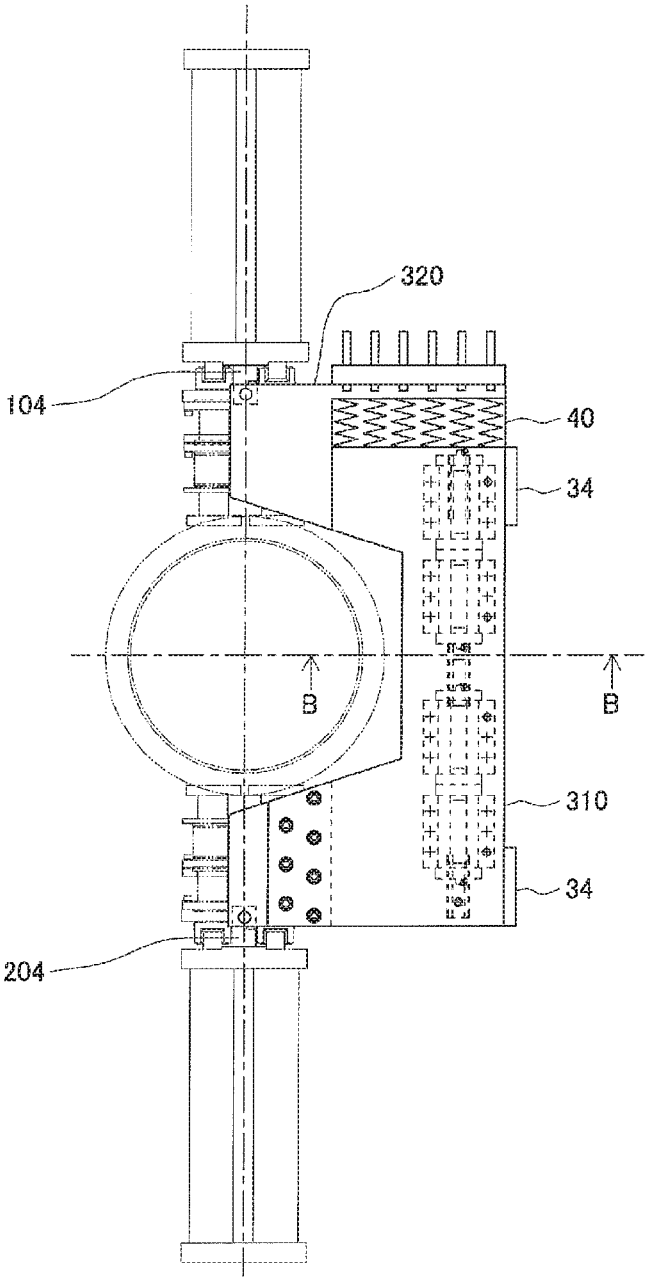
FIG. 10A is a side view of a compensation module according to the third embodiment.
Figure 10B:
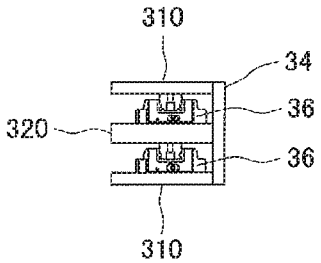
FIG. 10B is a horizontal cross-sectional view of the center portion of the spring conjunction mechanism according to the third embodiment.

Next, there will be described a third embodiment of the spring conjunction mechanisms 30, with reference to FIGS. 10A and 10B. FIG. 10A is a side view of a spring conjunction mechanism 30 according to the third embodiment. FIG.

10B is a horizontal cross-sectional view (a view taken along an arrow B-B) of the center portion in a plan view (a top view). In the third embodiment, the plate portions have a three-layer configuration, similarly to the first embodiment. Vertical guide mechanisms 36 are different in placement from that in the first embodiment. As illustrated in FIG. 10B, the vertical guide mechanisms 36 are placed between the surfaces of first plate portions 310 and a second plate portion 320 which are faced to each other, in the side farther from magnet arrays.

Fourth Embodiment

Figure 11A:
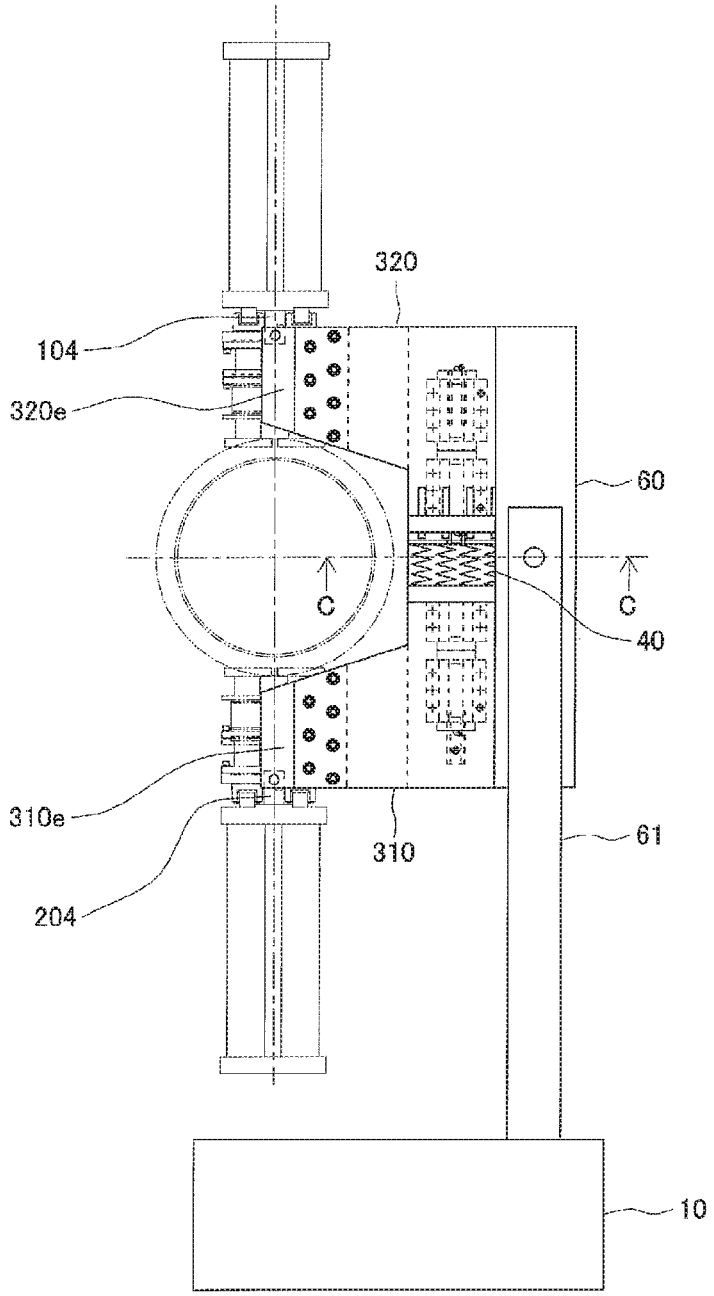
FIG. 11A is a side view of a compensation module according to a fourth embodiment.
Figure 11B:
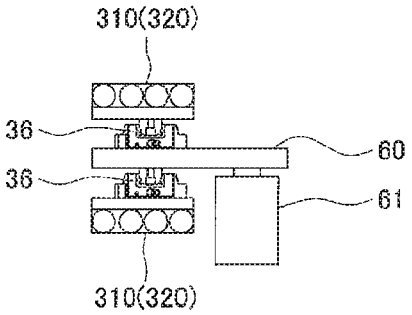
FIG. 11B is a horizontal cross-sectional view of the center portion of the spring conjunction mechanism according to the fourth embodiment.

Next, there will be described a fourth embodiment of the spring conjunction mechanisms 30, with reference to FIGS. 11A and 11B. FIG. 11A is a side view of a spring conjunction mechanism 30 according to the fourth embodiment. FIG. 11B is a horizontal cross-sectional view (a view taken along an arrow C-C) of the center portion in a plan view (a top view).

In the present embodiment, there is provided a fixed frame 60, which is secured to a base 10 (or a placement surface such as a floor, which corresponds to a foundation) with a supporting frame 61 interposed therebetween. The fixed frame 60 is formed to have a plate shape and is adapted not to move, regardless of the operations of compensation springs 42. Second plate portions 320 are placed in an upper side in the vertical direction, and first plate portions 310 are placed in a lower side. A pair of the first plate portions 310 and a pair of the second plate portions 320 are placed in such a way as to sandwich the fixed frame 60 therebetween. There are provided respective vertical guide mechanisms 36, between the surfaces of the first plate portions 310 and the fixed frame 60 which are faced to each other, and between the surfaces of the second plate portions 320 and the fixed frame 60 which are faced to each other. They function as a first vertical guide mechanism and a second vertical guide mechanism, respectively.

The first plate portions 310 include a protruding portion 310*e* in the front side which is the side closer to the magnet arrays, and the second plate portions 320 include a protruding portion 320*e* in the front side which is the side closer to the magnet arrays. The first and second coupling portions have the same structure. Compensation spring mechanisms 40 are placed between the first plate portions 310 and the second plate portions 320.

The spring conjunction mechanisms 30 can be maintained at a stabilized state, since they are secured to the placement surface through the fixed frame 60.

Fifth Embodiment

Figure 12A:
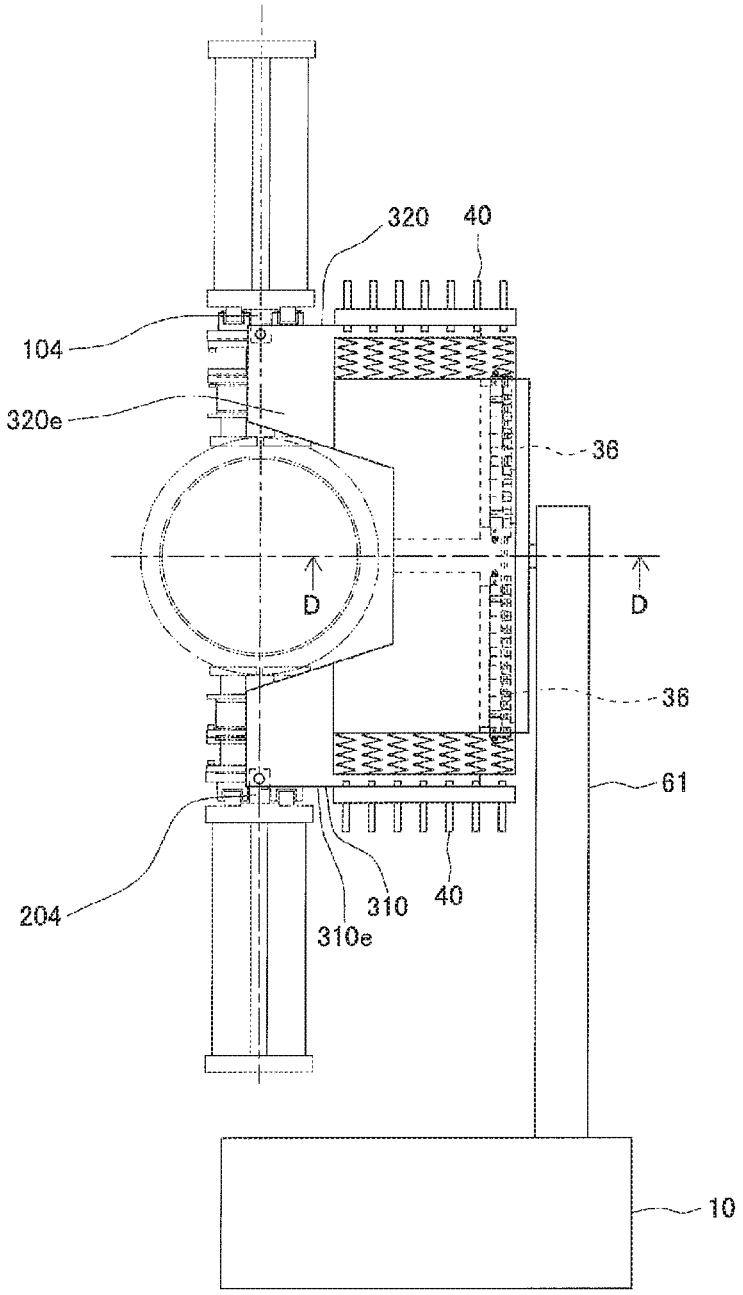
FIG. 12A is a side view of a compensation module according to a fifth embodiment.
Figure 12B:
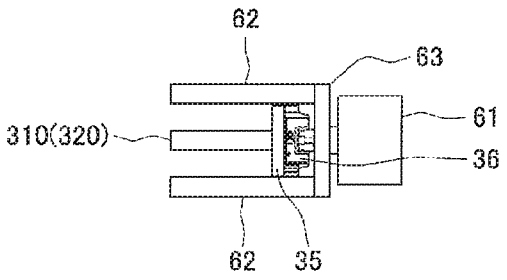
FIG. 12B is a horizontal cross-sectional view of the center portion of the spring conjunction mechanism according to the fifth embodiment.

Next, there will be described a fifth embodiment of the spring conjunction mechanisms 30. FIG. 12A is a side view of a spring conjunction mechanism 30 according to the fifth embodiment. FIG. 12B is a horizontal cross-sectional view (a view taken along an arrow D-D) of the center portion in a plan view (a top view).

In the fifth embodiment, there are provided a pair of fixed frames 62, which are coupled to each other through a coupling plate 63 at their rear sides, which are their sides farther from magnet arrays. Further, the coupling plate 63 is further secured to a base 10 (or a placement surface such as a floor, which corresponds to a foundation), through a supporting frame 61. Between the pair of the fixed frames 62 faced to each other, a second plate portion 320 is provided in an upper-portion space, and a first plate portion 310 is provided in a lower-portion space. The first plate portion 310 is provided with a protruding portion 310*e* in its side closer to the magnet arrays, and the second plate portion 320 is provided with a protruding portion 320*e* in its side closer to the magnet arrays.

There are provided respective compensation spring mechanisms 40 on the lower side of the first plate portion 310 and on the upper side of the second plate portion 320. A placement plate 35 is provided on the rear side of the first plate portion 310 which is its side farther from the magnet arrays, and a vertical guide mechanism 36 (corresponding to a first vertical guide mechanism) is provided between the placement plate 35 and the coupling plate 63. A placement plate 35 is also provided on the rear side of the second plate portion 320 which is its side farther from the magnet arrays, similarly, and a vertical guide mechanism 36 (corresponding to a second vertical guide mechanism) is provided between the placement plate 35 and the coupling plate 63. The first and second coupling portions have the same structure.

Other Embodiments

It is possible to conceive various types of examples of modifications regarding the concrete structure of the gap driving mechanisms, and the structure of the gap driving mechanisms is not limited to the structure according to the present embodiment. In the present embodiment, the first coupling beam 103 and the second coupling beam 203 in the upper and lower sides are both adapted to move in the vertical direction. However, only any one of them can be adapted to move. The gap driving mechanisms can be either provided both above and under the vacuum vessel (the magnet arrays) or provided only thereabove or thereunder.

In the present embodiment, compressive coil springs are employed as the compensation springs 42. However, the compensation springs 42 are not limited thereto. Further, it is also possible to employ hydraulic cylinders (a type of liquid springs) or compressed-air cylinders (a type of gas springs), which are springs in a broad sense. In this case, the spring stresses can be controlled by adjusting the hydraulic pressure or the air pressure.

In the present embodiment, the compensation spring mechanisms are placed only above the magnet arrays. However, the compensation spring mechanisms can also be placed only under the magnet arrays or both above and under the magnet arrays.

In the present embodiment, the first coupling portion and the second coupling portion are adapted to attain coupling in such a way as to allow relative rotation therein. However, the first coupling portion and the second coupling portion can also have a coupling configuration adapted to prevent relative rotation therein. Further, as such a structure for allowing relative rotation therein, it is also possible to employ other structures than that in the present embodiment. Regarding the relationship between the fitting holes and the shafts in the first and second coupling portions, the shafts can be integrally provided in any of the coupling-beam side and the spring-conjunction-mechanism side, and the fitting holes can be provided in the other. Also, the fitting holes can be provided in both of them, while the shafts can be formed to be independent members. Further in the case of providing the fitting holes in the spring-conjunction-mechanism side, the fitting holes are designated by reference characters 310*f*, 320*f* and 33*a* (FIG. 7A and the like).

In the present embodiment, the second spring supporting frame 32 is coupled to the first coupling beam 103, and the first coupling beam 103 is coupled to the second coupling beam 203. However, they can also be interchanged.

In the present embodiment, the terms "first" and "second" are used for various types of components, and they are used for convenience of the description. These terms are not intended to restrict the placements of elements, for example, such that they should be positioned at upper or lower positions.

In the present embodiment, the first coupling portion and the second coupling portion are provided on the lower end portion of the first coupling beam 103 and on the upper end portion of the second coupling beam 203, in order that they can get closest to the magnet arrays. However, the first coupling portion and the second coupling portion are not limited thereto. Any one of the first and second coupling portions can also be provided on the upper end portion of the first coupling beam 103 or can be provided at a position at the height of the center portion. The same applies to the second coupling beam 203.

The insertion device to which the characteristic structures such as the compensation modules and the like according to the present invention are applied is not limited to that described in the present embodiment. These characteristic structures can also be applied to various types of insertion devices which have been conventionally well known. Further, the compensation modules according to the present invention can also be applied to existing insertion devices having the same structure, as well as can be applied as portions of insertion devices to be newly fabricated.

DESCRIPTION OF REFERENCE SIGNS

M1 First magnet array
M2 Second magnet array
δ Gap
1 First magnet supporting member
2 Second magnet supporting member
3 Vacuum vessel
4 Pedestal
10 Base
100 Coupling shaft (magnet supporting member coupling shaft)
101 Coupling plate (magnet supporting member coupling plate)
102 Magnet supporting member guide mechanism
103 First coupling beam
104 Coupling plate (beam coupling plate)
105 Coupling shaft (beam coupling shaft)
200 Coupling shaft (magnet supporting member coupling shaft)
201 Coupling plate (magnet supporting member coupling plate)
202 Magnet supporting member guide mechanism
203 Second coupling beam
204 Coupling plate (beam coupling plate)
205 Coupling shaft (beam coupling shaft)
30 Spring conjunction mechanism
31 First spring supporting frame
32 Second spring supporting frame
33 Coupling block
33*a* Fitting hole
34 Coupling plate
36 Guide mechanism (vertical guide mechanism)
310 First plate portion
310*a* Upper-portion protruding portion
310*b* Lower-portion protruding portion
310*d* Spring placement portion
310*e* Protruding portion
310*f* Fitting hole
320 Second plate portion
320*a* Upper-portion protruding portion
320*b* Compressive-force exertion portion
320*e* Protruding portion
320*f* Fitting hole
40 Compensation spring mechanism
42 Compensation spring
43 Pusher
43*a* Pressing portion
50 Gap driving mechanism
60 Fixed frame
61 Supporting frame
62 Fixed frame
7 Ball screw mechanism
70 Screw shaft portion
71 Nut portion
8 Compensation module

The invention claimed is:

1. An insertion device comprising:

a first magnet array comprising a plurality of magnets placed in an array;

a first magnet supporting member adapted to support the first magnet array mounted to the first magnet supporting member;

a second magnet array comprising a plurality of magnets placed in an array and being faced to the first magnet array with a gap interposed therebetween;

a second magnet supporting member adapted to support the second magnet array mounted to the second magnet supporting member;

a gap driving mechanism for driving the first magnet supporting member and/or the second magnet supporting member in a direction in which the first and second magnet arrays are faced to each other, in order to change a size of the gap;

a first coupling beam coupled integrally to the first magnet supporting member;

a second coupling beam coupled integrally to the second magnet supporting member;

a driving conjunction mechanism for coupling at least one of the first coupling beam and the second coupling beam to the gap driving mechanism;

a compensation spring mechanism adapted to act in such another direction as to cancel an attractive force acting between the first magnet array and the second magnet array; and a spring conjunction mechanism for coupling the compensation spring mechanism and the first and second coupling beams to each other, wherein the spring conjunction mechanism includes:

a first spring supporting frame coupled, through a first coupling portion, to one of the first coupling beam or the second coupling beam, a second spring supporting frame coupled, through a second coupling portion, to an other one of the first coupling beam or the second coupling beam, and a guide mechanism for guiding relative movement of the first spring supporting frame and the second spring supporting frame, in the direction in which the magnet arrays are faced to each other, the compensation spring mechanism is mounted to both the first spring supporting frame and the second spring supporting frame and, when the size of the gap is changed, the first spring supporting frame and the second spring supporting frame move relative to each other in the direction in which the magnet arrays are faced to each other, so that the compensation spring mechanism operates.

2. The insertion device according to claim 1, wherein one of the first spring supporting frame and the second spring supporting frame includes a pair of first plate portions, and a plate coupling portion which is provided on the pair of first plate portions in their sides farther from the magnet arrays and is adapted to couple the pair of first plate portions to each other, in a plan view, the pair of first plate portions are coupled, at their sides closer to the magnet arrays, to one of the first coupling beam or the second coupling beam, through the first coupling portion, the other one of the first spring supporting frame and the second spring supporting frame includes a second plate portion placed in such a way as to be sandwiched between the pair of the first plate portions in a plan view, the second plate portion is coupled, at its side closer to the magnet arrays, to the other one of the first coupling beam or the second coupling beam, through the second coupling portion, and the guide mechanism is provided between the plate coupling portion and a side of the second plate portion which is farther from the magnet arrays.

3. The insertion device according to claim 1, wherein one of the first spring supporting frame and the second spring supporting frame includes a pair of first plate portions, and a plate coupling portion which is provided on the pair of the first plate portions in their sides farther from the magnet arrays and is adapted to couple the pair of the first plate portions to each other, in a plan view, the pair of the first plate portions are coupled, at their sides closer to the magnet arrays, to one of the first coupling beam or the second coupling beam, through the first coupling portion, the other one of the first spring supporting frame and the second spring supporting frame includes a second plate portion placed in such a way as to be sandwiched between the pair of the first plate portions in a plan view, the second plate portion is coupled, at its side closer to the magnet arrays, to the other one of the first coupling beam or the second coupling beam, through the second coupling portion, and the guide mechanism is provided between the sides of the pair of the first plate portions which are farther from the magnet arrays, and a side of the second plate portion which is farther from the magnet arrays.

4. The insertion device according to claim 1, wherein one of the first spring supporting frame and the second spring supporting frame includes a first plate portion in a plan view, the first plate portion is coupled, at its side closer to the magnet arrays, to one of the first coupling beam or the second coupling beam, through the first coupling portion, the other one of the first spring supporting frame and the second spring supporting frame includes a second plate portion placed in such a way as to be faced to the first plate portion in the plan view, the second plate portion is coupled, at its side closer to the magnet arrays, to the other one of the first coupling beam or the second coupling beam, through the second coupling portion, and the guide mechanism is provided between a surface of the first plate portion in its side farther from the magnet arrays and a surface of the second plate portion in its side farther from the magnet arrays which are faced to each other.

5. The insertion device according to claim 1, wherein the first coupling portion and the second coupling portion have a structure for coupling through a combination of a shaft and a fitting hole fittable to the shaft.

6. The insertion device according to claim 1, wherein one of the first spring supporting frame and the second spring supporting frame is provided with a placement portion adapted to place, thereon, a compensation spring in the compensation spring mechanism, and an other one of the first spring supporting frame and the second spring supporting frame is provided with a compressive-force exertion portion adapted to exert a compressive force on the compensation spring.

7. The insertion device according to claim 1, wherein the spring conjunction mechanism further comprises a fixed frame secured to a foundation, and a plurality of guide mechanisms, and the spring conjunction mechanism comprises:

a first guide mechanism adapted to guide the first spring supporting frame relative to the fixed frame in the direction in which the magnet arrays are faced to each other, and a second guide mechanism adapted to guide the second spring supporting frame relative to the fixed frame in the direction in which the magnet arrays are faced to each other, and when the size of the gap is changed, the spring conjunction mechanism is adapted to allow the first spring supporting frame and the second spring supporting frame to move relative to the fixed frame, in the direction in which the magnet arrays are faced to each other.

8. The insertion device according to claim 1, wherein the second coupling portion is provided on the first coupling beam in its side closer to the first magnet array, and the first coupling portion is provided on the second coupling beam in its side closer to the second magnet array.

9. The insertion device according to claim 1, wherein the spring conjunction mechanism is placed in a rear side with respect to the magnet arrays, in a side view.

10. A compensation module for use in an insertion device, the insertion device comprising:

a first magnet array comprising a plurality of magnets placed in an array;

a first magnet supporting member adapted to support the first magnet array mounted to the first magnet supporting member;

a second magnet array comprising a plurality of magnets placed in an array and being faced to the first magnet array with a gap interposed therebetween;

a second magnet supporting member adapted to support the second magnet array mounted to the second magnet supporting member;

a gap driving mechanism for driving the first magnet supporting member and/or the second magnet supporting member in a direction in which the first and second magnet arrays are faced to each other, in order to change a size of the gap;

a first coupling beam coupled integrally to the first magnet supporting member;

a second coupling beam coupled integrally to the second magnet supporting member; and a driving conjunction mechanism for coupling at least one of the first coupling beam and the second coupling beam to the gap driving mechanism, the compensation module comprising:

a compensation spring mechanism adapted to act in such another direction as to cancel an attractive force acting between the first magnet array and the second magnet array; and a spring conjunction mechanism for coupling the compensation spring mechanism and the first and second coupling beams to each other, wherein the spring conjunction mechanism includes:

a first spring supporting frame coupled, through a first coupling portion, to one of the first coupling beam or the second coupling beam, a second spring supporting frame coupled, through a second coupling portion, to an other one of the first coupling beam or the second coupling beam, and a guide mechanism for guiding relative movement of the first spring supporting frame and the second spring supporting frame, in the direction in which the magnet arrays are faced to each other, and the compensation spring mechanism is mounted to both the first spring supporting frame and the second spring supporting frame and, when the size of the gap is changed, the first spring supporting frame and the second spring supporting frame move relative to each other in the direction in which the magnet arrays are faced to each other, so that the compensation spring mechanism operates.

11. The compensation module according to claim 10, comprising:

a pair of first plate portions, and a plate coupling portion which is provided on the pair of the first plate portions in their sides farther from the magnet arrays and is adapted to couple the pair of the first plate portions to each other, in a plan view, the pair of the first plate portions and the plate coupling portion being provided in one of the first spring supporting frame and the second spring supporting frame;

a second plate portion placed in such a way as to be sandwiched between the pair of the first plate portions in a plan view, the second plate portion being provided in an other one of the first spring supporting frame and the second spring supporting frame; and the guide mechanism provided between the plate coupling portion and a side of the second plate portion which is farther from the magnet arrays.

12. The compensation module according to claim 10, comprising:

a pair of first plate portions, and a plate coupling portion which is provided on the pair of the first plate portions in their sides farther from the magnet arrays and is adapted to couple the pair of the first plate portions to each other, in a plan view, the pair of the first plate portions and the plate coupling portion being provided in one of the first spring supporting frame and the second spring supporting frame;

a second plate portion placed in such a way as to be sandwiched between the pair of the first plate portions in a plan view, the second plate portion being provided in an other one of the first spring supporting frame and the second spring supporting frame; and the guide mechanism provided between the sides of the pair of the first plate portions which are farther from the magnet arrays, and a side of the second plate portion which is farther from the magnet arrays.

13. The compensation module according to claim 10, comprising:

a first plate portion provided in one of the first spring supporting frame and the second spring supporting frame;

a second plate portion placed in such a way as to be faced to the first plate portion in a plan view, the second plate portion being provided in an other one of the first spring supporting frame and the second spring supporting frame; and the guide mechanism provided between a surface of the first plate portion in its side farther from the magnet arrays and a surface of the second plate portion in its side farther from the magnet arrays which are faced to each other.

* * * * *